US011635076B2

(12) United States Patent
Koenig et al.

(10) Patent No.: US 11,635,076 B2
(45) Date of Patent: Apr. 25, 2023

(54) VARIABLE DISPLACEMENT VANE PUMP WITH IMPROVED PRESSURE CONTROL AND RANGE

(71) Applicant: SLPT Global Pump Group, Rochester Hills, MI (US)

(72) Inventors: Dennis N. Koenig, Hartland, MI (US); Douglas G. Hunter, Rochester Hills, MI (US); Fuzheng Hu, Toronto (CA); Matthew J. Jannausch, Lake Orion, MI (US)

(73) Assignee: SLW Automotive Inc., Sallisaw, OK (US)

( * ) Notice: Subject to any disclaimer, the term of this patent is extended or adjusted under 35 U.S.C. 154(b) by 0 days.

(21) Appl. No.: 17/580,950

(22) Filed: Jan. 21, 2022

(65) Prior Publication Data

US 2022/0235764 A1 Jul. 28, 2022

Related U.S. Application Data

(60) Provisional application No. 63/140,609, filed on Jan. 22, 2021.

(51) Int. Cl.

| | |
|---|---|
| ***F04C 2/344*** | (2006.01) |
| ***F04C 14/22*** | (2006.01) |
| ***F04C 15/00*** | (2006.01) |

(52) U.S. Cl.

CPC ..... *F04C 2/344* (2013.01); *F04C 14/226* (2013.01); *F04C 15/0034* (2013.01); *F04C 2240/30* (2013.01); *F04C 2270/185* (2013.01)

(58) Field of Classification Search

CPC .... F04C 2/344; F04C 14/226; F04C 15/0034; F04C 2240/30; F04C 2270/185

See application file for complete search history.

(56) References Cited

U.S. PATENT DOCUMENTS

| | | | | |
|---|---|---|---|---|
| 8,684,702 | B2 * | 4/2014 | Watanabe | F04C 14/226 417/220 |
| 9,903,367 | B2 * | 2/2018 | Watanabe | F04C 2/344 |
| 10,161,398 | B2 * | 12/2018 | Saga | F04C 2/344 |
| 11,168,684 | B2 * | 11/2021 | Saga | F04C 2/344 |

* cited by examiner

*Primary Examiner* — Mary Davis
(74) *Attorney, Agent, or Firm* — Warn Partners, P.C.

(57) ABSTRACT

An arrangement of a variable capacity vane pump for an automobile is provided that includes a pump housing having an outlet and inlet. A pump control ring is provided having a cavity. The control ring is positioned within the housing to move about a pivot. A vane pump rotor is positioned within the cavity of the pump control ring. A position of the pump control ring determines an offset between a center of the pump control ring cavity and an axis of rotation of the vane pump rotor. Vanes are provided that are driven by the rotor and which engage an interior surface of the pump control ring. The vanes and the engaged surface defining working fluid chambers. A first control chamber is provided. The first control chamber is exposed to a first side of the pivot between the pump housing and the outer surface of the pump control ring. The first control chamber is operable to receive pressurized fluid to create a force to move the pump control ring to reduce a volumetric capacity of the pump. A second control chamber, positioned between the pump inlet and outlet is provided that provides a hydraulic force to increase the volumetric capacity of the pump.

19 Claims, 4 Drawing Sheets

VARIABLE DISPLACEMENT VANE PUMP WITH IMPROVED PRESSURE CONTROL AND RANGE

FIELD OF THE INVENTION

The present invention relates to an arrangement of a variable capacity vane pump.

BACKGROUND OF THE INVENTION

Variable capacity vane pumps are well known and can include a capacity adjusting element, in the form of a pump control ring that can be moved to alter the eccentricity of the pump and hence alter the volumetric capacity of the pump. If the pump is supplying a system with a substantially constant speed and hydraulic resistance, such as a lubrication system of an automobile vehicle engine, changing the output flow of the pump is equivalent to changing the pressure produced by the pump.

Having the ability to alter the volumetric capacity of the pump to maintain an equilibrium pressure is important in environments such as automotive lubrication pumps, wherein the pump will be operated over a range of operating speeds and temperatures. In such environments, to maintain an equilibrium pressure it is known to employ a feedback pressure of the pumping fluid (e.g., lubricating oil) from the engine to a control chamber adjacent the pump control ring, the pressure in the control chamber acting to move the control ring, typically against a biasing force from a return spring, to alter the capacity of the pump.

When the pressure at the engine increases, such as when the operating speed of the pump increases, the increased pressure is applied to a solenoid valve, which in turn applies a greater pressure to the control ring to overcome the bias of the return spring and to move the control ring to reduce the capacity of the pump, thus reducing the output flow and hence the pressure at the output of the pump.

Conversely, as the pressure at the engine, such as when the operating speed of the pump decreases, the decreased pressure applied to the control chamber by the solenoid valve adjacent the control ring allows the bias of the return spring to move the control ring to increase the capacity of the pump, raising the output flow and hence pressure of the pump. In this manner, an equilibrium pressure is obtained at the output of the pump.

The equilibrium pressure is determined by the area of the control ring against which the pumping fluid in the control chamber acts, the pressure of the pumping fluid supplied to the chamber and the bias force generated by the return spring.

Conventionally, the equilibrium pressure is selected to be a pressure which is acceptable for the expected operating range of the engine and is thus somewhat of a compromise as, for example, the engine may be able to operate acceptably at lower operating speeds with a lower pumping fluid pressure than is required at higher engine operating speeds. To prevent undue wear or other damage to the engine, the engine designers will select an equilibrium pressure for the pump which meets the worst case (high operating speed) conditions. Thus, at lower speeds, the pump will be operating at a higher capacity than necessary for those speeds, wasting energy pumping the surplus, unnecessary, pumping fluid.

It is desired to have a variable capacity vane pump which can provide at least two selectable equilibrium pressures in a reasonably compact pump housing. It is desirable to provide an arrangement of a vane pump with improved pump performance and capability range without adding cost or size.

SUMMARY OF THE INVENTION

To make manifest the above noted and other positive desires, a revelation of the present invention is brought forth. The present invention endows a freedom of an arrangement of an automobile variable capacity vane pump that includes a pump housing having an outlet and inlet. A pump control ring is provided having a cavity. The control ring is positioned within the housing to move about a pivot. A vane pump rotor is positioned within the cavity of the pump control ring. A position of the pump control ring determines an offset between a center of the pump control ring cavity and an axis of rotation of the vane pump rotor. Vanes are provided that are driven by the rotor and which engage the interior surface of the pump control ring. The vanes and the engaged surface at least partially defining pumping fluid chambers. A first control chamber is provided. The first control chamber is exposed to a first circumferential side of the pivot between the pump housing and the pump control ring. The first control chamber is positioned on an opposite (outer) side of the pump control ring as the (inner) pumping fluid chambers. The first control chamber is operable to receive pressurized fluid to create a force to move the pump control ring to reduce a volumetric capacity of the pump.

A second control chamber is provided between the pump housing and a second outer surface of the pump control ring. The second outer surface of the pump control ring is positioned on an opposite (outer) side of the pump control ring as the (inner) pumping fluid chambers. The second control chamber is operable to receive pressurized fluid to create a force to move the pump control ring to increase the volumetric capacity of the pump. A major portion if not total portion of the second control chamber is juxtaposed between the housing outlet and the housing inlet. The housing outlet juxtaposes a second circumferential side of the pivot and a major portion of the second control chamber.

A return spring is provided biasing the pump control ring toward a position of maximum volumetric capacity. The return spring acting against the forces created by the pressurized fluid within the first control chamber. The return spring is exposed to the inlet and is in a position sealed from the first and second chambers.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
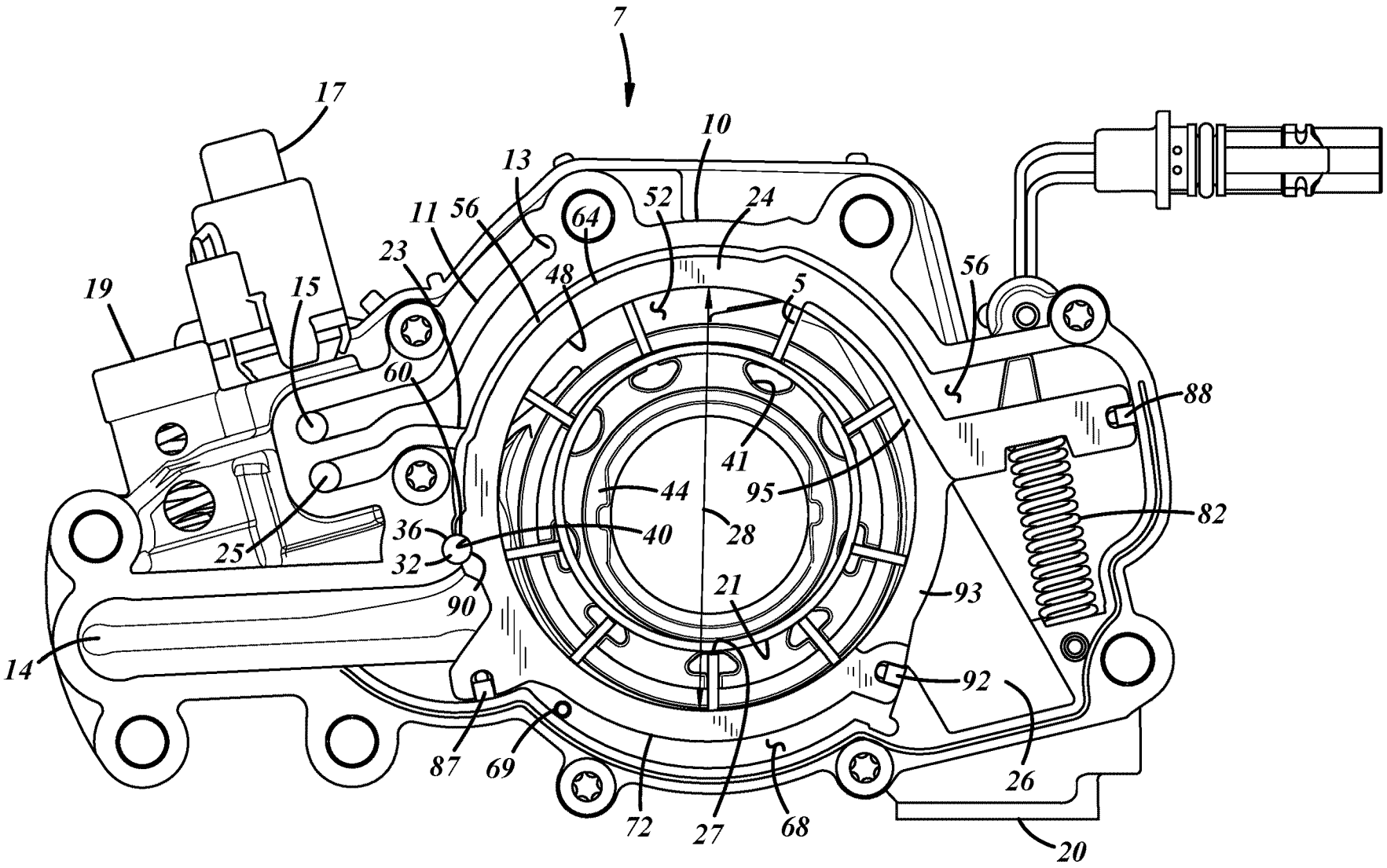
FIG. 1 is a rear plane view with a cover plate removed of an arrangement of a variable capacity vane pump of the present invention at maximum displacement.

The following description of the preferred embodiment(s) is merely exemplary in nature and is in no way intended to limit the invention, its application, or uses.

Referring to FIGS. 1-4, an arrangement 7 of a variable capacity vane lubrication pump for an automobile with a drive train including an engine is provided. The pump 7 includes a pump housing 10 having an outlet 14 and inlet 20. The pump housing 10 additionally mounts a solenoid valve 17 and a pressure relief valve 19.

A pump control ring 24 is provided having a cavity 28. The control ring 24 is positioned within the housing 10 to move about a pivot 32. The pivot 32 includes a pin 36 fixed to the housing 10, wherein a portion of the pump control ring includes a curved surface 40 engaging a portion 90 of the pin 36. Shown best in FIG. 3, the inlet passage 20 has approximately one-half portion 47 of its opening offset from the plane 51 that the control ring 24 pivots in.

The pump housing 10 has an internally formed fluid line 11 having a port end 13 for fluidly connecting with a main oil gallery (after the fuel filter) of an engine. The line 11 has a port end 15 for connecting to a valve supply and sensing port of the solenoid valve 17 that is mounted in the pump housing 10. The solenoid valve 17 can be a two level or fully variable solenoid valve.

A vane pump rotor 44 is positioned within the cavity of the pump control ring 24. A position of the pump control ring 24 determines an offset between a center of the pump control ring cavity and an axis of rotation of the vane pump rotor 44. Vanes 5 are provided slidably mounted in mushroom shaped radially outward extending stem slots 41. Vanes 5 are driven by the rotor 44 and which engage an inner cylindrical surface 48 of the pump control ring that surrounds the cavity 28. An inner radial tip surface 27 of the vanes 5 make aligning contact with upper and lower vane rings 21 (only one shown). The vanes 5 and the engaged surface 48 at least partially defining pumping fluid chambers 52.

Figure 2:
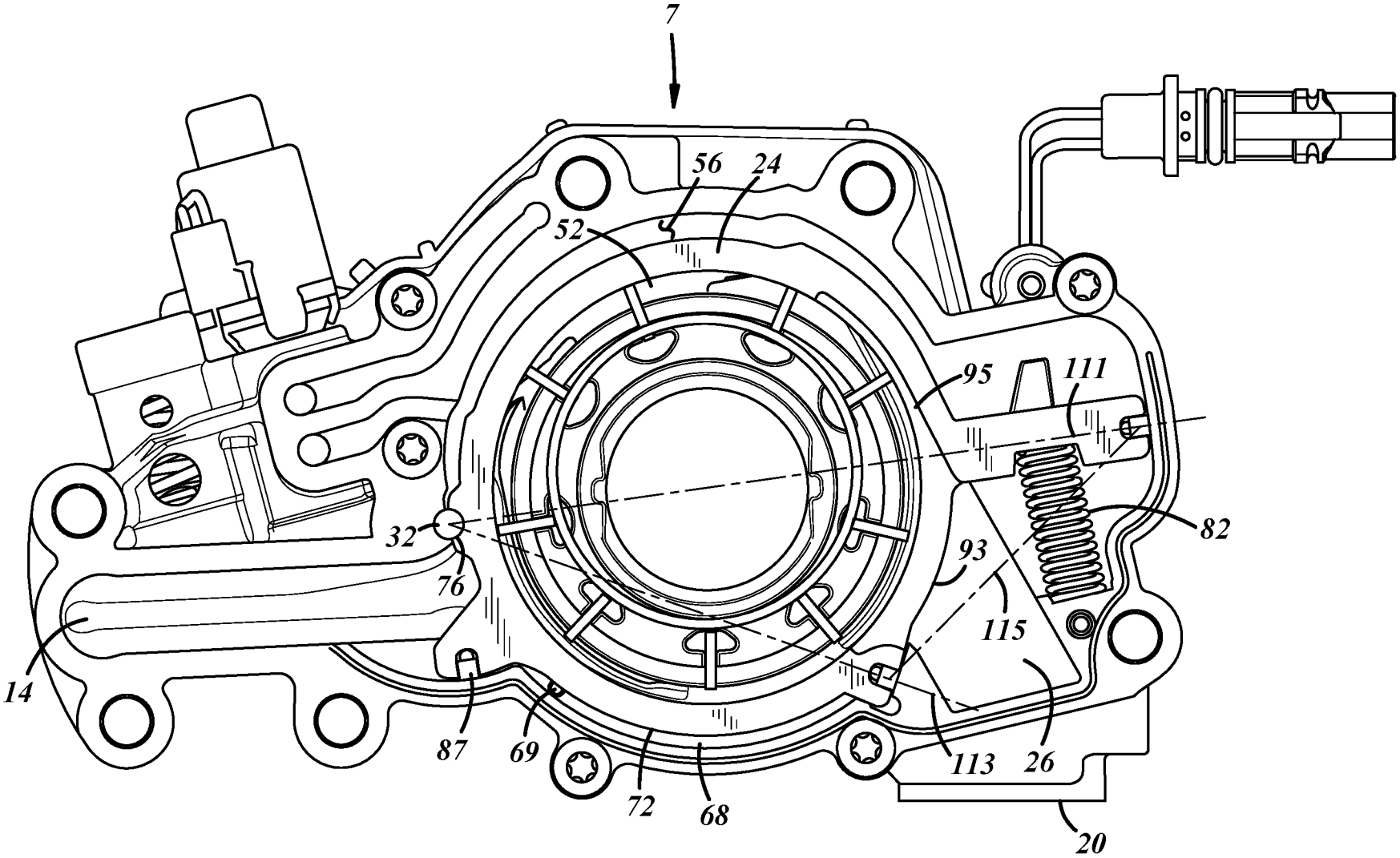
FIG. 2 is a rear plane view of an arrangement of a variable capacity vane pump as shown in FIG. 1 at minimum displacement.
Figure 3:
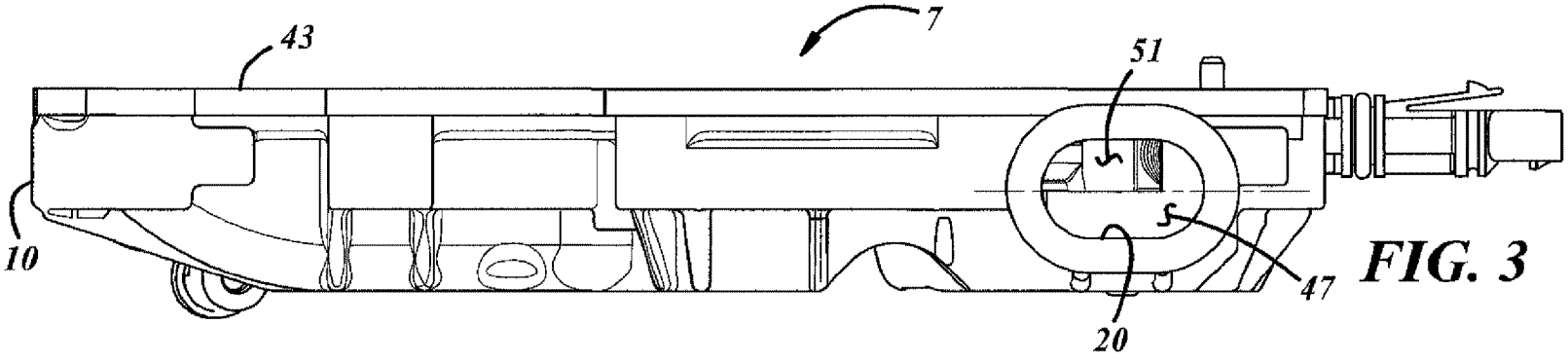
FIG. 3 is a bottom view illustrating an inlet of the variable capacity vane pump as shown in FIG. 1.
Figure 4:
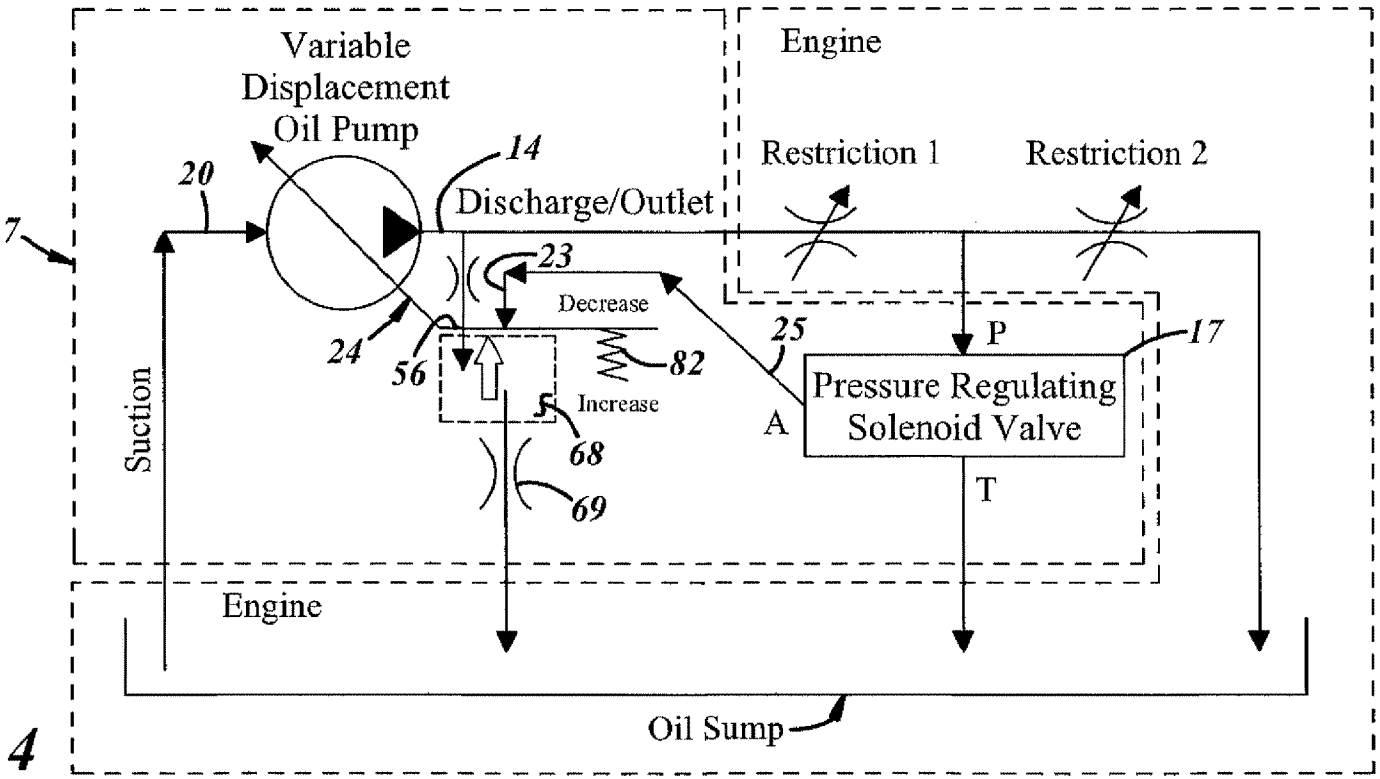
FIG. 4 is a hydraulic schematic drawing of the variable capacity vane pump of the present invention installed in a vehicle engine powertrain lubrication system.

A first control chamber 56 is provided. The first control chamber 56 is exposed to a first circumferential side 60 of the pivot 32 between the pump housing 10 and a first outer surface 64 of the pump control ring. The first outer surface of the pump control ring 64 is positioned on a radially outer side of the pump control ring as the pumping fluid chambers 52. The first control chamber 56 is operable to receive pressurized fluid to create a force to move the pump control ring to reduce a volumetric capacity of the pump 7. The pump housing 10 has internally formed line 23 having a port end 25 for fluidly connecting a control port of the solenoid valve 17 with the first control chamber 56. The pivot 32 acts as a seal at one end (a left end as shown in FIGS. 1 and 2) of the first control chamber 56.

A second control chamber 68 is provided between the pump housing 10 and a second outer surface 72 of the pump control ring. The second outer surface 72 of the pump control ring 24 is positioned on a radially outward or opposite side of the pump control ring as the pumping fluid chambers 52. The second control chamber 68 is operable to receive pressurized fluid to create a force to move the pump control ring 24 to increase the volumetric capacity of the pump 7. The second control chamber 68 has a restricted drain 69. The second control chamber 68 receives fluid pressurized in the area of the pump outlet 14 that escapes through the horizontal (as shown in FIG. 1) interface clearance between the pump control ring 24 and the housing 10 (including the interface of the cover 43, see FIG. 3) of the pump control ring 24.

A major portion if not the entire of the second control chamber 68 is juxtaposed between and the housing outlet 14 and the inlet 20. The housing outlet 14 juxtaposes a second circumferential side 76 of the pivot 32 and a major portion if not the entire of second control chamber 68. A sealing member 87 can be utilized to seal the second control chamber 68 from the outlet 14. In an embodiment of the invention (not shown), a second control chamber extends to and is sealed by the pivot. Thus, the sealing member 87 is not required. The outlet then loops over the control ring and the second control chamber, however a major portion of the second control chamber is juxtaposed from the pivot by this "loop" outlet design.

A return spring 82 is provided biasing the pump control ring 24 toward a position of maximum volumetric capacity. The return spring 82 acts against the forces created by the pressurized fluid within the first control chamber 56. The return spring 82 is exposed to the inlet port 26 (sometimes referred to as suction port) and is in a position sealed from the first and second chambers 56 and 68 by mechanically biased (sometimes referred to as spring biased) seals 88 and 92, respectively. A first radial arm 111 defined by a line from the pivot 32 to a sealing member 88 between the first control chamber 56 and the inlet port 26 is greater in length than a second radial arm 113 defined by a line from the pivot 32 to a sealing member 92 between the second chamber 68 and the inlet port 26 and wherein at least 75% of the length of the spring is between the first 111 and second radial arms 113. A third line 115 defined by a line from sealing member 92 to sealing member 88 bisects the spring 82.

The control ring 24, on the top and bottom has reduced thickness area 93 to facilitate fluid from inlet port 26 entering the pumping chambers 52. The reduced thickness area 93 extends beyond the radial arm 111 to an area 95 that is opposite the first control chamber 56.

Figure 5:
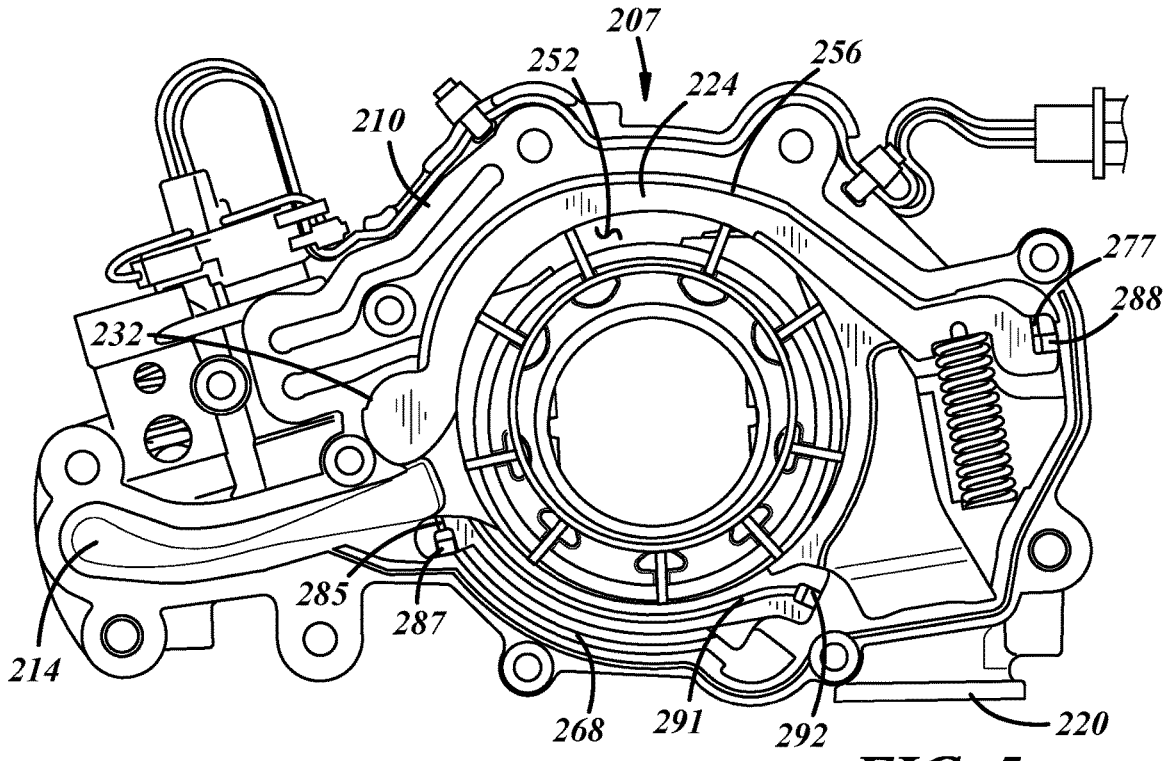
FIG. 5 is a rear view of an alternate preferred arrangement of a variable capacity vane pump of the present invention to that shown in FIG. 1.
Figure 6:
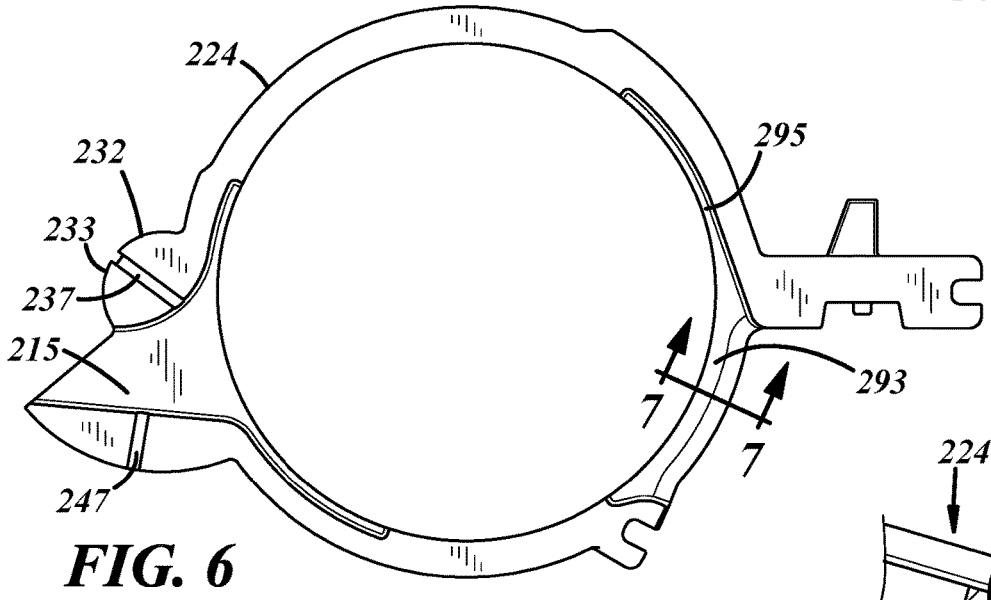
FIG. 6 is a top plane view of a control ring of the variable capacity vane pump shown in FIG. 5.
Figure 7:
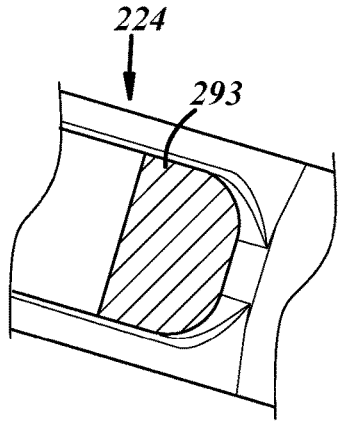
FIG. 7 is a partial sectional view of a reduced thickness area of control ring of the variable capacity vane pump as shown in FIG. 2 in an area adjacent to an inlet of the pump.

Referring to FIGS. 5-7, an alternative preferred embodiment pump 207 is provided wherein the pivot 232 includes a portion of a pump control ring 224 that includes a curved surface 233 engaging a correspondingly curved portion of the of the housing 210. Pump 207 has a first control chamber 256 that is sealed from the area exposed to the inlet 220, by a pressurized seal 288. Line 277 is utilized to pressurize the seal 288. Grooves 237 and 247 are provided to deliver lubricant to aid the control ring 224 pivotal movement with respect to the housing 10. Pump 207 has a second control chamber 268 sealed by pressurized seals 287 and 292. Seals 287 and 292 are energized by pressurization lines 285 and 291 respectively (seal pressurization lines are not shown in FIG. 6 for clarity of illustration). Adjacent to the outlet 214, the control ring 224 has a reduced with portion 215 allowing pressurized lubricant in pumping chambers 252 to more easily pass on both sides of the control ring 224 to the outlet 214. The control ring 224 has reduced thickness areas 293 and 295 similar to reduced thickness areas 93 and 95 previously described for the control ring 24 in FIGS. 1 and 2.

In operation the pump 7 in FIG. 1 is urged to a maximum displacement by virtue of the force exerted by the spring 82. Pump solenoid valve 17 is fluidly connected with the engine to sense the engine oil pressure at a location typically downstream of the engine oil filter. The solenoid valve 17 controls the pressure within the first control chamber 56 as a function of the actual and desired lubricant pressure in the engine to regulate it to the target pressure. In some operations, the solenoid valve will be connected with the vehicle engine control module. If increased fluid pressure is desired (in the engine) the solenoid valve 17 is de-energized which will reduce the pressure in the first control chamber 56 by draining to a sump. If decreased fluid pressure is desired (in the engine) the solenoid valve 17 will expose the first control chamber 56 to the main oil gallery 13 to increase the pressure within the first control chamber 56 to lower the displacement of the pump 7. Undesired oscillation variations between maximum and minimum output will be response dampened by the pressure in the second chamber 68. The current invention allows for the use of a smaller spring and thus reduces the space package requirement of the pump 7. The additional increase control chamber pressure supplied by the second control chamber provides more on stroke force for resisting high-speed/flow de-stroke. The orifice drain 69 of the second control chamber 68 dampens potential instability. The additional force of the second control chamber naturally compensates for solenoid valve pressure regulator gain and flattens the control curve.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. An arrangement of a variable capacity vane pump for an automobile including a drivetrain in receipt of a fluid pressurized by the pump, the pump arrangement comprising:

a pump housing having an outlet and inlet;

a pump control ring including a cavity and positioned within the housing to move about a pivot;

a vane pump rotor positioned within the cavity of the pump control ring, wherein a position of the pump control ring determines an offset between a center of the pump control ring cavity and an axis of rotation of the vane pump rotor;

vanes being driven by the rotor and engaging an inner surface of the pump control ring that surrounds the cavity, the vanes and the pump control ring inner surface at least partially defining pumping fluid chambers;

a first control chamber positioned on a first circumferential side of the pivot between the pump housing and an outer surface of the pump control ring, the outer surface of the pump control ring being positioned on an opposite side of the pump control ring as the pumping fluid chambers, the first control chamber being operable to receive pressurized fluid to create a force to move the pump control ring to reduce a volumetric capacity of the pump;

a second control chamber positioned on a second circumferential side of the pivot between the pump housing and the pump control ring, the second control chamber being between the pump housing and the outer surface of the pump control ring, the second control chamber being operable to receive pressurized fluid to create a force to move the pump control ring to increase the volumetric capacity of the pump, and wherein the pump outlet juxtaposes a major portion of the second control chamber from the pivot;

wherein the inlet is sealed from the second chamber by a pressurized seal; and a return spring biasing the pump control ring toward a position of maximum volumetric capacity, the return spring acting against the forces created by the pressurized fluid within the first control chamber, the return spring being exposed to the inlet and being in a position sealed from the first and second chambers.

2. The variable capacity vane pump arrangement of claim 1, wherein the outlet is sealed from the second chamber.

3. The variable capacity vane pump arrangement of claim 1, wherein the drivetrain includes an engine.

4. The variable capacity vane pump arrangement of claim 3, wherein the pump housing can mount a solenoid valve to selectively control the pressure within the first chamber as a function of the actual or desired lubricant pressure in the engine.

5. The variable capacity vane pump arrangement of claim 4, wherein the pump housing mounts a relief valve.

6. The variable capacity vane pump arrangement of claim 1, wherein the pivot includes a pin fixed to the housing, wherein a portion of the pump control ring includes a curved surface engaging a portion of the pin.

7. The variable capacity vane pump arrangement of claim 1 wherein the outlet juxtaposes an entirety of the second chamber from the pivot.

8. The variable capacity vane pump arrangement of claim 1, wherein the pivot forms a seal for one of the first and second control chambers.

9. The variable capacity vane pump arrangement of claim 1, wherein the vanes are slidably positioned within radially extending slots in the vane pump rotor.

10. The variable capacity vane pump arrangement of claim 1, wherein a radial arm defined by a line from the pivot to a seal separating the first chamber from an area of the pump exposed to the inlet is greater in length from a radial arm defined by a line from the pivot to a seal separating the second chamber from the area exposed to the inlet.

11. The variable capacity vane pump arrangement of claim 1 wherein the pivot is formed by a semicircular portion integrally formed on the pump control ring pivoting on a semicircular portion on the housing.

12. The variable capacity vane pump arrangement of claim 1, wherein the pump control ring includes an axial top and bottom reduced thickness area to facilitate fluid flow from the inlet to the pumping chambers.

13. The variable capacity vane pump arrangement of claim 12, wherein the axial top and bottom reduced thickness area extends to a section radially opposite the first chamber and past a radial arm defined by a line from the pivot to a seal separating the first chamber from an area of the pump exposed to the inlet.

14. The variable capacity vane pump arrangement of claim 1, wherein the pump control ring includes an axial top and bottom reduced thickness area to facilitate fluid flow from the pumping chambers to the outlet.

15. The variable capacity vane pump arrangement of claim 1, wherein the second control chamber has a restricted drain.

16. The variable capacity vane pump arrangement of claim 1, wherein the inlet is sealed from the first chamber by a pressurized seal.

17. The variable capacity vane pump arrangement of claim 1, wherein the inlet has approximately one half of its opening offset from a plane that the control ring pivots in.

18. An arrangement of a variable capacity vane pump for an automobile including a drivetrain in receipt of a fluid pressurized by the pump, the pump arrangement comprising:

a pump housing having an outlet and inlet, the pump housing also mounting a solenoid valve and a check valve;

a pump control ring including a cavity and positioned within the housing to move about a pivot in a first pivotal plane, the pump control ring includes a first axial top and bottom reduced thickness area to facilitate fluid flow from the pump housing inlet to an interior of the pump control ring, and wherein approximately one half of the inlet is offset from the first pivotal plane, the pump control ring includes a second axial top and bottom reduced thickness area to facilitate fluid flow from the interior of the pump control ring pump to the housing outlet;

a vane pump rotor positioned within the cavity of the pump control ring, wherein a position of the pump control ring determines an offset between a center of the pump control ring cavity and an axis of rotation of the vane pump rotor;

vanes being driven by the rotor and engaging an inner surface of the pump control ring that surrounds the cavity, the vanes and the inner surface at least partially defining pumping fluid chambers;

a first control chamber positioned on a first circumferential side of the pivot between the pump housing and a first outer surface of the pump control ring, the first outer surface of the pump control ring being positioned on an opposite side of the pump control ring as the pumping fluid chambers, the first control chamber operable to receive pressurized fluid to create a force to move the pump control ring to reduce a volumetric capacity of the pump, the first control chamber is sealed from an area exposed to the inlet by a first pressurized seal between the first chamber and the inlet;

a second control chamber between the pump housing and a second outer surface of the pump control ring, the second outer surface of the pump control ring being positioned on an opposite side of the pump control ring as the pumping fluid chambers, the second control chamber being operable to receive pressurized fluid to create a force to move the pump control ring to increase the volumetric capacity of the pump, and wherein the second control chamber is exposed to a drain by a restricted outlet, and wherein the second control chamber is juxtaposed between and sealed from the outlet and the inlet by a second pressurized seal and a third pressurized seal, and wherein the housing outlet juxtaposes a second circumferential side of the pivot and the second chamber;

and a return spring biasing the pump control ring toward a position of maximum volumetric capacity, the return spring acting against the forces created by the pressurized fluid within the first control chamber, the return spring being exposed to the inlet and being in a position sealed from the first and second chambers and wherein a first radial arm defined by a line from the pivot to the first pressurized seal between the first chamber and the inlet is greater in length than a second radial arm defined by a line from the pivot to the second pressurized seal between the second chamber and the inlet and wherein at least 75% of the length of the spring is between projections of the first and second radial arms.

19. An arrangement of a variable capacity vane pump for an automobile including a drivetrain in receipt of a fluid pressurized by the pump, the pump arrangement comprising:

a pump housing having an outlet and inlet, the pump housing also mounting a solenoid valve and a check valve;

a pump control ring including a cavity and positioned within the housing to move about a pivot in a first pivotal plane, the pivot being formed by a semicircular portion integrally formed on the pump control ring pivoting on a semicircular portion on the housing, the pump control ring includes a first axial top and bottom reduced thickness area to facilitate fluid flow from the pump housing inlet to an interior of the pump control ring, and wherein approximately one half of the inlet is offset from the first pivotal plane, the pump control ring includes a second axial top and bottom reduced thickness area to facilitate fluid flow from the interior of the pump control ring pump to the housing outlet;

a vane pump rotor positioned within the cavity of the pump control ring, wherein a position of the pump control ring determines an offset between a center of the pump control ring cavity and an axis of rotation of the vane pump rotor;

vanes being driven by the rotor and engaging an inner surface of the pump control ring that surrounds the cavity, the vanes and the inner surface at least partially defining pumping fluid chambers;

a first control chamber positioned on a first side of the pivot between the pump housing and a first outer surface of the pump control ring, the first outer surface of the pump control ring being positioned on an opposite side of the pump control ring as the pumping fluid chambers, the first control chamber operable to receive pressurized fluid to create a force to move the pump control ring to reduce a volumetric capacity of the pump, the first control chamber is sealed from an area exposed to the inlet by a first pressurized seal between the first chamber and the inlet;

a second control chamber between the pump housing and a second outer surface of the pump control ring, the second outer surface of the pump control ring being positioned on an opposite side of the pump control ring as the pumping fluid chambers, the second control chamber being operable to receive pressurized fluid to create a force to move the pump control ring to increase the volumetric capacity of the pump, and wherein the second control chamber is exposed to a drain by a restricted outlet, and wherein the second control chamber is juxtaposed between and sealed from the outlet and the inlet by a second pressurized seal and a third pressurized seal, and wherein the housing outlet juxtaposes a second circumferential side of the pivot and the second chamber;

and a return spring biasing the pump control ring toward a position of maximum volumetric capacity, the return spring acting against the forces created by the pressurized fluid within the first control chamber, the return spring being exposed to the inlet and being in a position sealed from the first and second chambers and wherein a radial arm defined by a line from the pivot to the first pressurized seal between the first chamber and the inlet is greater in length than a radial arm defined by a line from the pivot to the second pressurized seal between the second chamber and the inlet and wherein a line from the second pressurized seal separating the second control chamber from the inlet to the first pressurized seal separating the first control chamber from the inlet bisects the return spring.

* * * * *